US009707770B2

(12) United States Patent
Powell

(10) Patent No.: US 9,707,770 B2
(45) Date of Patent: Jul. 18, 2017

(54) FLUID EJECTION DEVICE

(71) Applicant: FUNAI ELECTRIC CO., LTD., Daito-shi, Osaka (JP)

(72) Inventor: Wade Powell, Lexington, KY (US)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 14/876,420

(22) Filed: Oct. 6, 2015

(65) Prior Publication Data

US 2016/0052287 A1 Feb. 25, 2016

Related U.S. Application Data

(63) Continuation of application No. 14/427,985, filed on Mar. 12, 2015, now abandoned, which is a continuation of application No. PCT/IB2013/002780, filed on Sep. 16, 2013.

(60) Provisional application No. 61/700,919, filed on Sep. 14, 2012.

(51) Int. Cl.
*B41J 2/175* (2006.01)

(52) U.S. Cl.
CPC ..... *B41J 2/17526* (2013.01); *B41J 2/1752* (2013.01); *B41J 2/17523* (2013.01)

(58) Field of Classification Search
CPC ..... B41J 2/175; B41J 2/1752; B41J 2/1755; B41J 2/17523; B41J 2/17526; B41J 2/17546; B41J 2/17553; B41J 29/02
USPC ..... 347/7, 49, 50, 85, 86, 87
See application file for complete search history.

(56) References Cited

U.S. PATENT DOCUMENTS 5,250,957 A 10/1993 Onozato
5,971,525 A * 10/1999 Inoue ..... B41J 29/00 347/50
6,190,010 B1 * 2/2001 Tanaka ..... B41J 2/17513 347/108
6,250,750 B1 6/2001 Miyazawa et al.
(Continued)

FOREIGN PATENT DOCUMENTS

EP 1344650 A1 9/2003
GB 2298822 A 9/1996
JP 2012148572 8/2012

OTHER PUBLICATIONS

International Search Report of PCT/IB2013/002780 dated Mar. 18, 2014.
Written Opinion of PCT/IB2013/002780 dated Mar. 18, 2014.

*Primary Examiner* — Anh T. N. Vo
(74) *Attorney, Agent, or Firm* — Amster, Rothstein & Ebenstein, LLP

(57) ABSTRACT

A printer including an ink supply, a printhead cartridge, at least one fluid connection between the printhead cartridge and the ink supply, the printhead cartridge having a first configuration in which the fluid connection is coupled and the printhead cartridge is in electrical contact with other components of the printer and a second configuration in which the fluid connection is decoupled and the printhead cartridge is out of electrical contact with the other components of the printer, a cover latch having an open configuration and a closed configuration, and at least one moveable ejector arm that is mechanically linked to the cover latch so that the at least one ejector arm engages the printhead cartridge and forces the printhead cartridge towards the second configuration as the cover latch is moved towards the open configuration.

20 Claims, 7 Drawing Sheets

(56) References Cited

U.S. PATENT DOCUMENTS

| | | | | |
|---|---|---|---|---|
| 6,378,987 | B2 | 4/2002 | Balakrishnan et al. | |
| 6,481,829 | B1 | 11/2002 | Bailey et al. | |
| 6,520,625 | B1 * | 2/2003 | Kawakami | B41J 25/34 347/49 |
| 6,736,486 | B2 * | 5/2004 | Nakamura | B41J 2/1752 347/49 |
| 6,779,880 | B1 | 8/2004 | Kulpa et al. | |
| 7,246,882 | B2 * | 7/2007 | Shinada | D06M 13/44 347/50 |
| 7,452,066 | B2 * | 11/2008 | Tsuji | B41J 2/1752 347/108 |
| 7,484,825 | B2 | 2/2009 | Asauchi | |
| 7,562,958 | B2 | 7/2009 | Asauchi | |
| 7,802,877 | B2 * | 9/2010 | Hashii | B41J 2/17503 347/85 |
| 8,025,374 | B2 * | 9/2011 | Berry | B41J 2/1721 347/85 |
| 8,366,233 | B2 | 2/2013 | Asauchi | |
| 8,382,250 | B2 | 2/2013 | Asauchi | |
| 8,454,116 | B2 | 6/2013 | Asauchi | |
| 8,794,749 | B2 | 8/2014 | Asauchi | |
| 8,801,163 | B2 | 8/2014 | Asauchi | |
| 8,882,513 | B1 | 11/2014 | Asauchi | |
| 9,180,675 | B2 | 11/2015 | Asauchi | |
| 9,381,750 | B2 | 7/2016 | Asauchi | |
| 9,505,226 | B2 | 11/2016 | Asauchi | |
| 2002/0015077 | A1 | 2/2002 | Eckard et al. | |
| 2008/0068409 | A1 | 3/2008 | Harada et al. | |
| 2009/0051746 | A1 | 2/2009 | Asauchi | |
| 2009/0256884 | A1 | 10/2009 | Aoki | |
| 2010/0157001 | A1 | 6/2010 | Berry et al. | |
| 2017/0036450 | A1 | 2/2017 | Asauchi | |

* cited by examiner

FLUID EJECTION DEVICE

FIELD

The present invention generally relates to systems and methods for ejecting an inkjet printhead from an inkjet printer.

BACKGROUND

Known pagewide imaging devices, e.g., printers, include a printhead in the form of a removable cartridge made up of lengthy arrays of ejection nozzles. On occasion, the printhead requires maintenance or replacement. In a particular known design, a user must rotate a release lever to disengage fluidic connections between the printhead cartridge and the ink supply. Once complete, users grip the cartridge tightly and pull it to a side to rotate it free of electrical connections made by numerous spring-loaded contacts. Users then lift the cartridge containing the head by pulling with sufficient force to un-snap it from the printer. Unfortunately, these steps are difficult to perform, particularly since they are not intuitive. They remain difficult to perform even after users become acquainted with the process because such pagewide printers use "clunky" interfaces between mechanical structures.

To re-load the cartridge, users must perform the foregoing process in reverse. First, the cartridge must be lowered into the printer and sufficient force must be applied to snap the cartridge back into its initial position. Second, users must rotate the cartridge onto its datums and back into contact with the numerous electrical contacts. The force that must be applied is rather high and many users, thinking that application of such force might cause breakage of the device, do not apply enough force to put the cartridge into a proper position. After completing these steps, users next return the lever to its closed position which re-engages the fluidic connection to the head.

Overall, the conventional method of removal and replacement of printhead cartridges requires too many steps to be conveniently committed to memory. Since the process is not required regularly during the life of the printer, even users who can commit the process to memory often forget the steps before needing to remove and replace another cartridge. In general, the actions involved in the process remain exceptionally difficult for even the most experienced of users.

SUMMARY OF THE INVENTION

A printer according to an exemplary embodiment of the present invention comprises: an ink supply; a printhead cartridge; at least one fluid connection between the printhead cartridge and the ink supply, the printhead cartridge having a first configuration in which the fluid connection is coupled and the printhead cartridge is in electrical contact with other components of the printer and a second configuration in which the fluid connection is decoupled and the printhead cartridge is out of electrical contact with the other components of the printer; a cover latch having an open configuration in which at least a portion of the printhead cartridge is exposed and a closed configuration in which the printhead cartridge is covered by the cover latch; and at least one moveable ejector arm that is mechanically linked to the cover latch so that the at least one ejector arm engages the printhead cartridge and forces the printhead cartridge towards the second configuration as the cover latch is moved towards the open configuration.

In at least one embodiment, the printhead cartridge comprises a pagewidth printhead.

In at least one embodiment, the at least one moveable ejector arm is mechanically linked to the cover latch by a cam mechanism.

In at least one embodiment, the at least one ejector arm is moveable in a direction perpendicular to a longitudinal axis of the printhead cartridge.

In at least one embodiment, the printer further comprises a cartridge holder comprising a slanted wall that the printhead cartridge rests against in the second configuration.

In at least one embodiment, the at least one ejector arm comprises a downward extending projection that engages with a top portion of the printhead cartridge as the cover latch is moved towards the open configuration to tilt the printhead cartridge towards the second configuration.

In at least one embodiment, the at least one moveable ejector arm comprises two ejector arms, one on each side of the printer.

Other features and advantages of embodiments of the invention will become readily apparent from the following detailed description, the accompanying drawings and the appended claims.

BRIEF DESCRIPTION OF THE DRAWINGS

The features and advantages of exemplary embodiments of the present invention will be more fully understood with reference to the following, detailed description when taken in conjunction with the accompanying figures, wherein.

DETAILED DESCRIPTION

Figure 1:
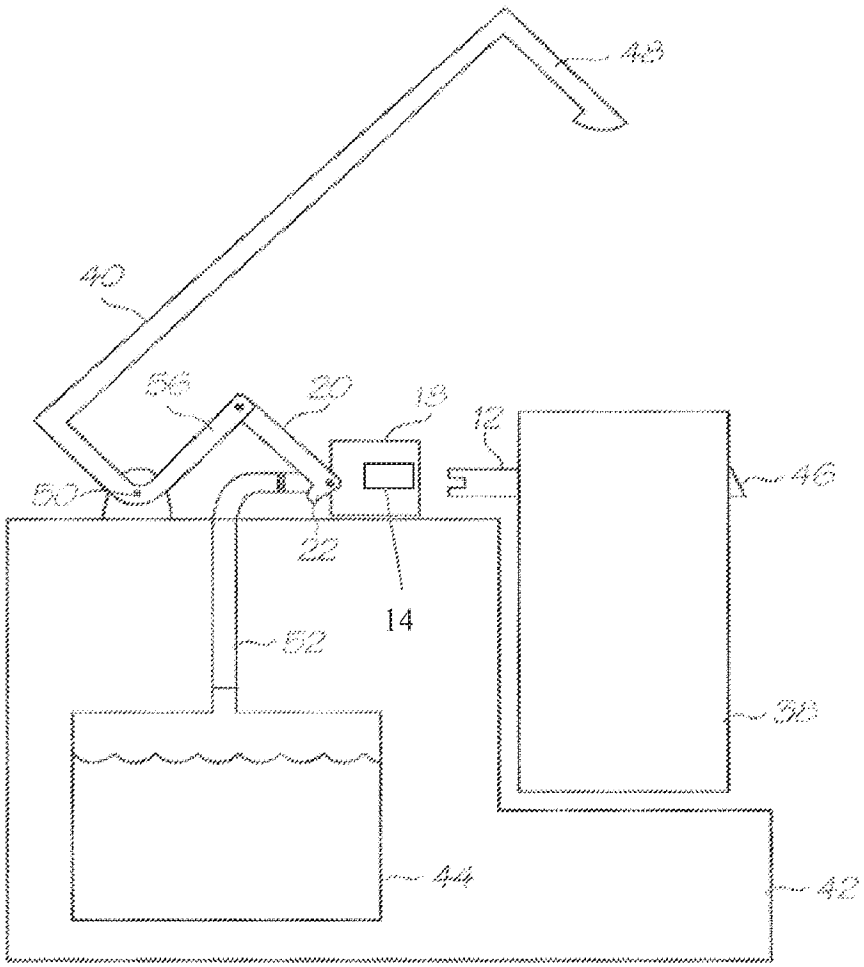
FIGS. 1 and 2 show a conventional detachable connection between a cartridge and a printer.
Figure 2:
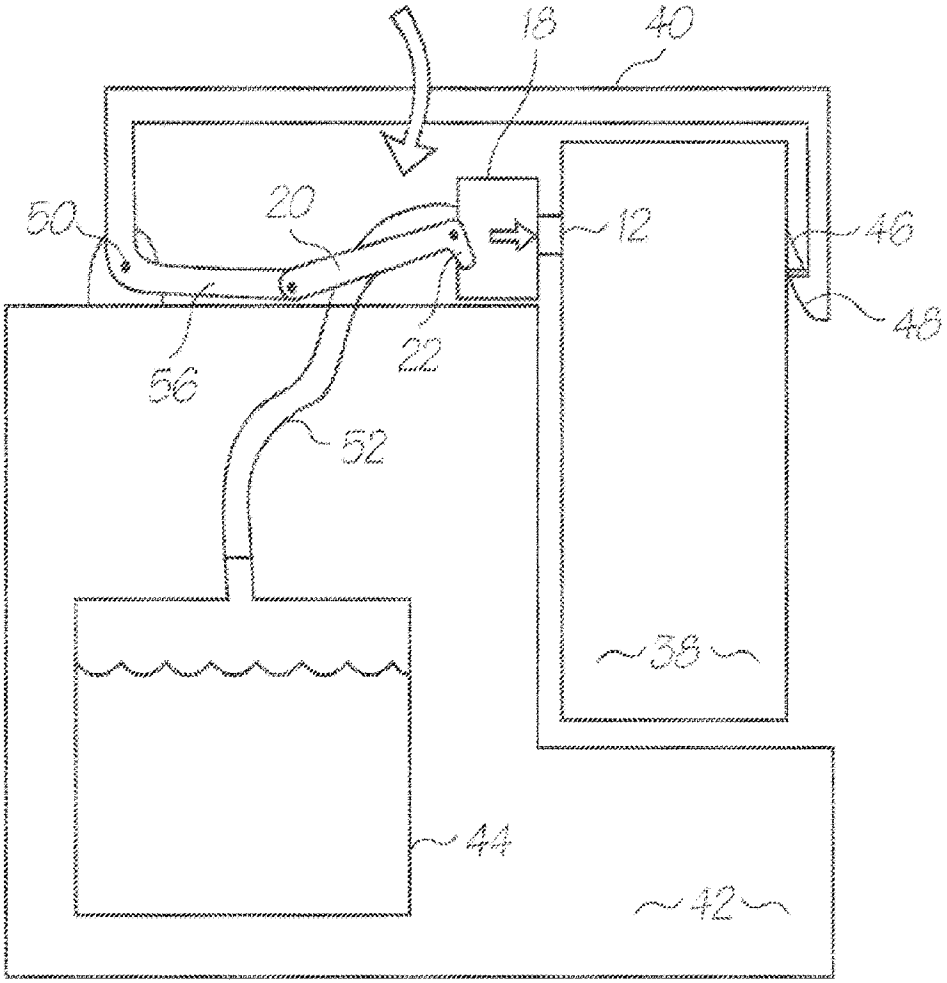

FIGS. 1 and 2 show a conventional detachable connection between a cartridge and a printer, such as described in U.S. Pat. No. 8,444,257, the contents of which are incorporated herein by reference in their entirety. The printer, generally designated by reference number 42, includes a first conduit 12 that leads to a pagewide printhead of a removable printhead cartridge 38 and a second conduit 14 connected to ink supply 44. The printer 42 may include one or more such first conduits 12 and one or more corresponding second conduits 14. The second conduit 14 is sized such that it can telescopically engage the first conduit 12 with a sliding fit. The second conduit 14 defines a seal seat (not shown) for an annular seal (not shown), which is retained in the seal seat by compression member 18. The cartridge 38 is seated in the printer 42 such that the first conduit 12 faces the compression member 18, which in turn covers the second conduit 14.

The latch cover 40 of the printer 42 is lifted to allow the cartridge 38 to be installed. An actuator arm 56 is fixed relative to the latch cover 40 and rotates therewith about a hinge 50. The distal end of the actuator arm 56 is hinged to the input arm 20. When the latch is raised for cartridge installation or removal, the input arm 20 is likewise raised, which retracts the compression member 18 away from the first conduit 12. With the input arm in the raised and retracted position, the compression lever 22 is disengaged from the back of the second conduit 14. The annular seal is not compressed in the disengaged position so as not to interfere with the sliding fit with the first conduit 12.

Referring to FIG. 2, the fluid coupling between first conduit 12 and second conduit 14 is engaged by simply lowering the latch 40 onto the cartridge 38 until the complementary snap-lock formations 46 and 48 engage. Actuator arm 56 rotates the input arm 20 and advances the compression member 18 towards the first conduit 12. The first conduit 12 telescopically engages the second conduit 14 with a loose sliding fit until the actuator arm 56 and the input arm 20 are parallel to the direction of travel. When the second conduit 14 is at its maximum engagement with the first conduit 12, a shut off valve is opened and the cartridge 38 is in fluid communication with ink tank 44 via a flexible tubing 52.

When the compression member 18 is at its point of maximum travel towards the cartridge 38, the compression lever 22 engages the second conduit 14. The compression lever 22 is dimensioned to hold the second conduit 14 stationary relative to the first conduit 12 as the input arm 20 continues to rotate and draw the compression member 18 back to compress the seal and establish the fluid seal.

Figure 3:
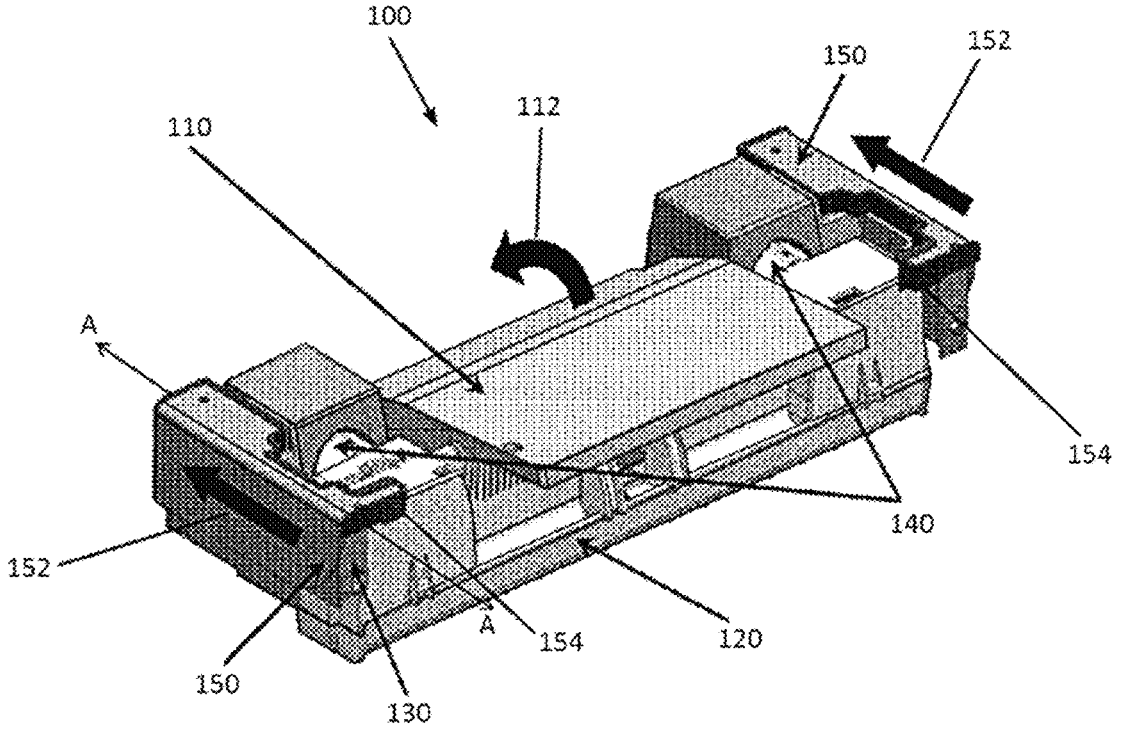
FIG. 3 is a perspective view of a pagewidth printer according to an exemplary embodiment of the present invention with its cover latch in the closed position.
Figure 4:
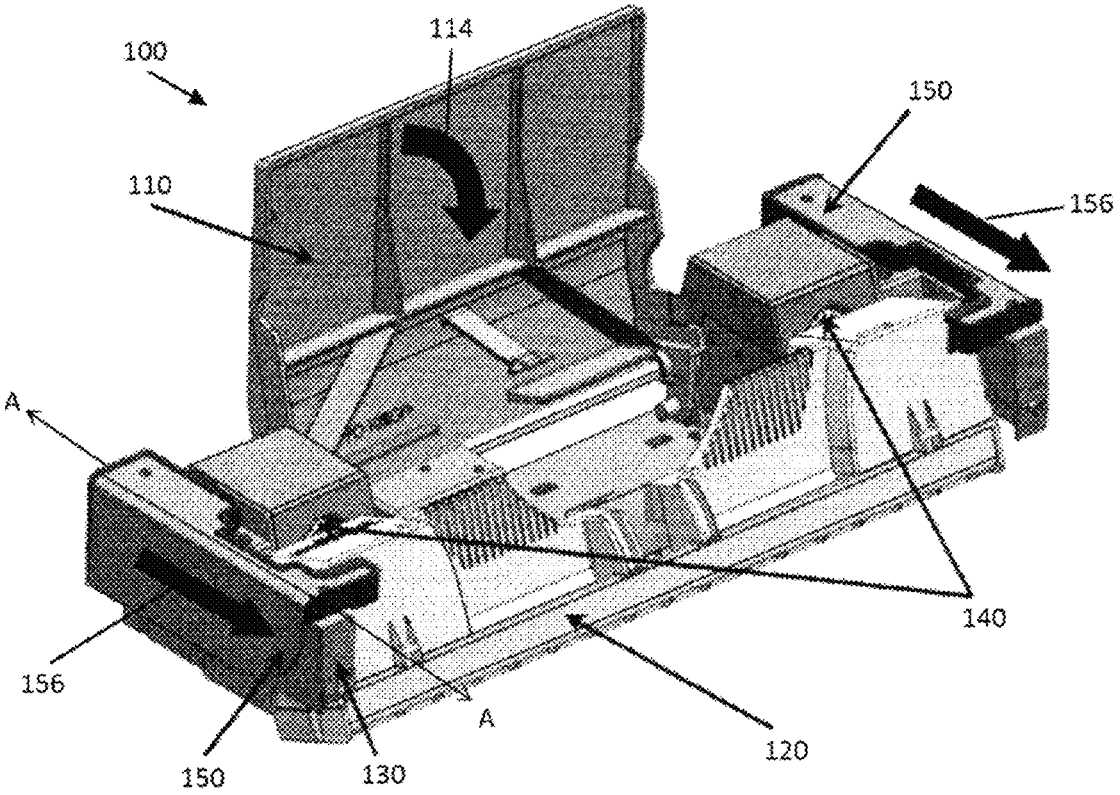
FIG. 4 is a perspective view of a pagewidth printer according to an exemplary embodiment of the present invention with its cover latch in the open position.

FIGS. 3 and 4 are perspective views of a pagewidth printer, generally designated by reference number 100, according to an exemplary embodiment of the present invention. The printer 100 includes a cover latch 110, printhead cartridge 120, cartridge holder 130, fluid connections 140 and printhead cartridge ejector arms 150. As described in more detail below, opening of the cover latch 110 in the direction of arrow 112 results in decoupling of the fluid connections 140 between the printhead cartridge 120 and an ink supply (not shown), as described previously, as well as movement of the ejector arms 150 in the direction of arrow 152. Movement of the ejector arms 150 in the direction of arrow 152 causes a downwardly projecting finger 154 on the distal end of each ejector arm 150 to come into contact with and pull on the top portion of the printhead cartridge 120, which in turn causes rotation of the printhead cartridge 120 out of contact with electrical connections with other components of the printer 100. The printhead cartridge 120 can then be easily removed for repair or replacement. Movement of the cover latch 110 in the direction of arrow 114 results in coupling of the fluid connections 140, as described previously, as well as movement of the ejector arms in the direction of arrow 156, which in turn allows for rotation of the printhead cartridge 120 back into its proper position and reestablishment of electrical connections with other components of the printer 100.

Figure 5:
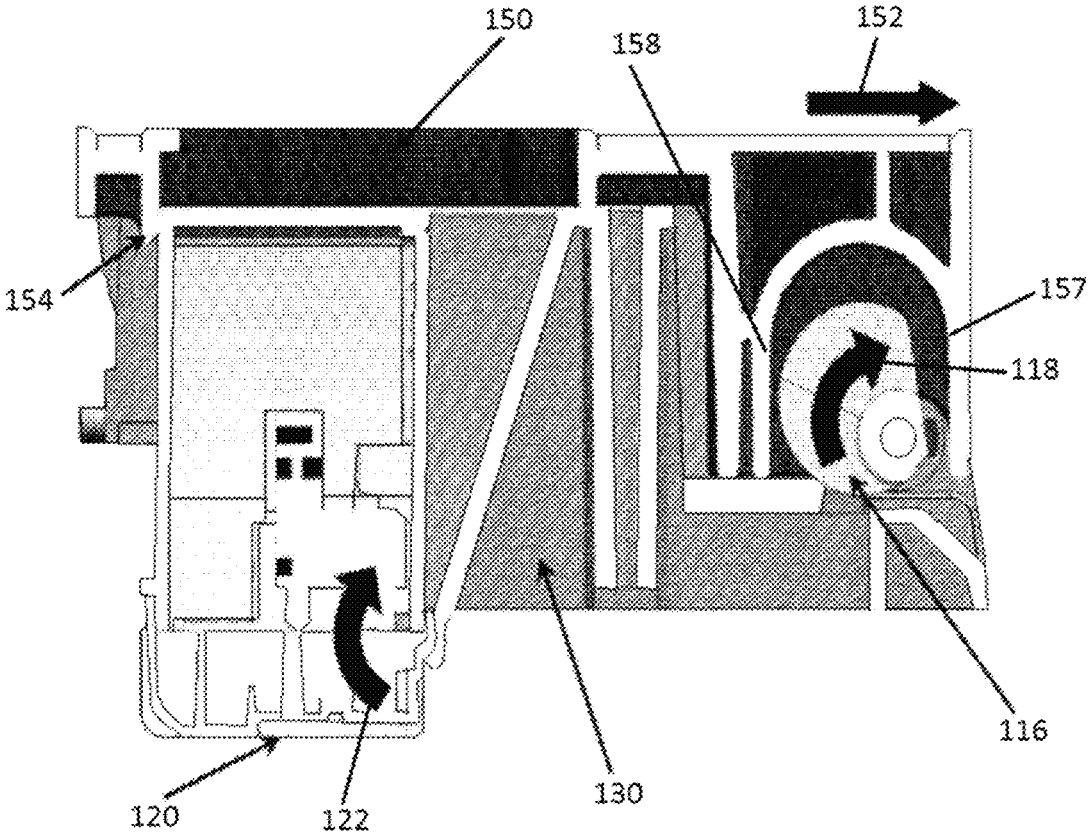
FIG. 5 is a cross-sectional view of a pagewidth printer according to an exemplary embodiment of the present invention with its cover latch in the closed position.
Figure 6:
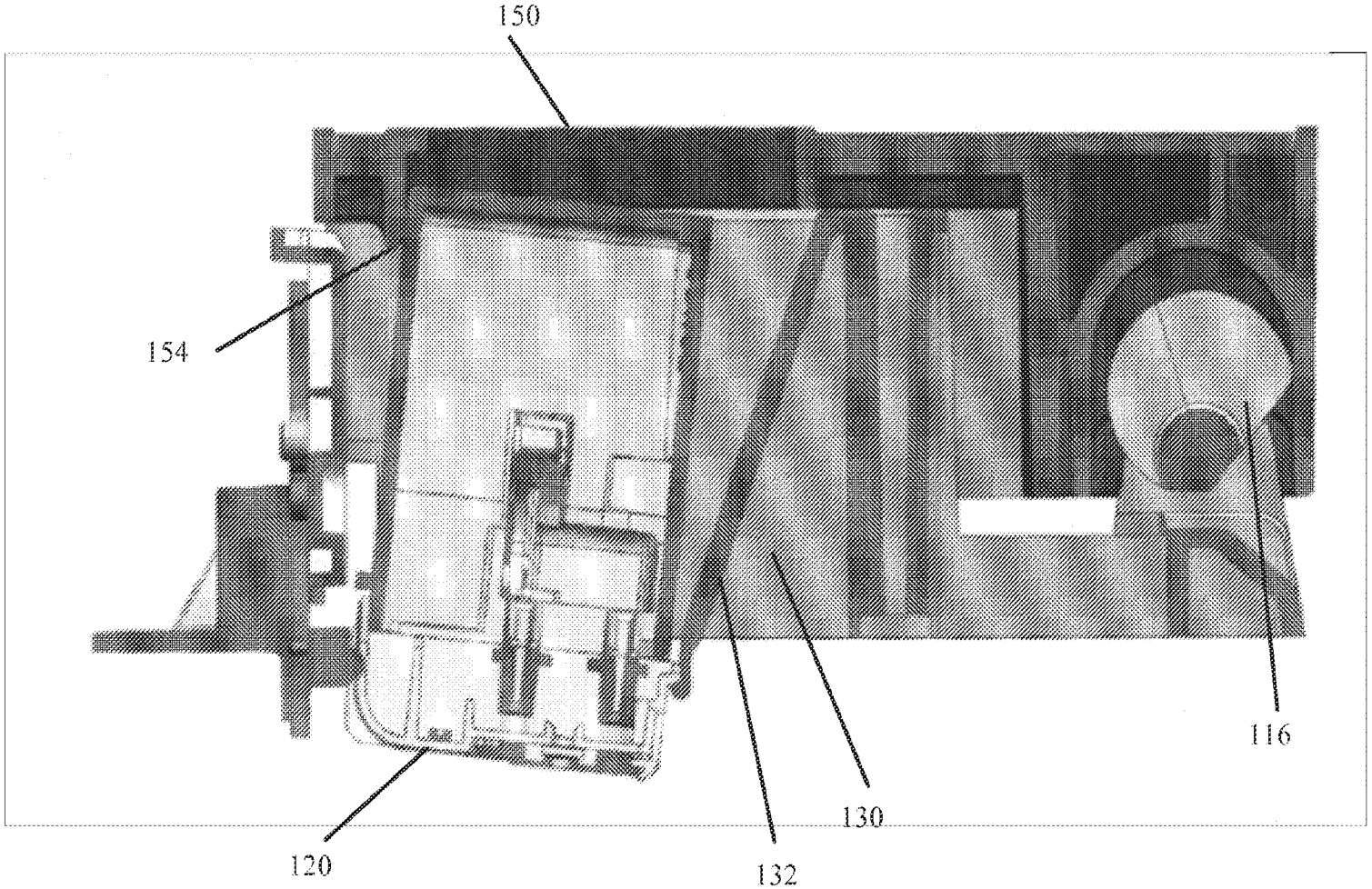
FIG. 6 is a cross-sectional view of a pagewidth printer according o an exemplary embodiment of the present invention with its cover latch in a partially open position.
Figure 7:
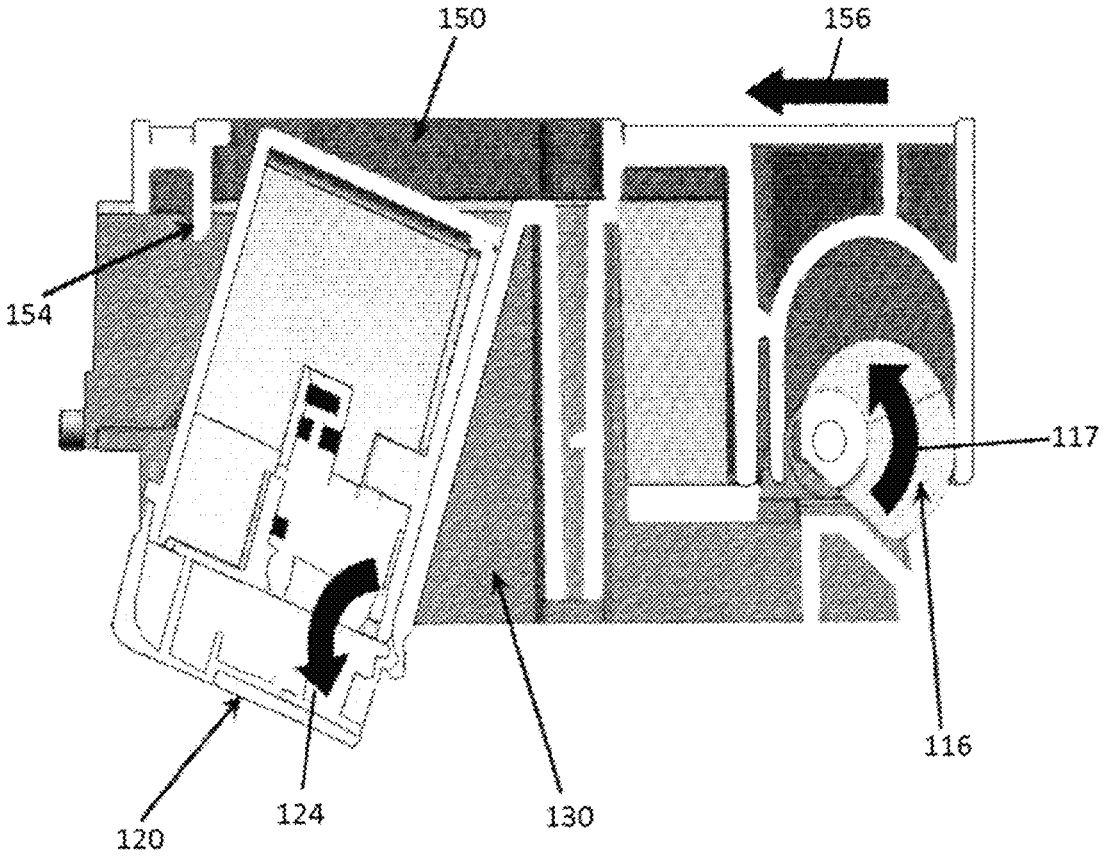
FIG. 7 is a cross-sectional view of a pagewidth printer according to an exemplary embodiment of the present invention with its cover latch in a fully open position.

FIGS. 5-7 are cross-sectional views of the pagewidth printer 100 taken along the lines A-A in FIGS. 3 and 4. As shown most clearly in FIGS. 5-7, a mechanical linkage exists between the cover latch 110 and the ejector arms 150. According to an exemplary embodiment, the mechanical linkage includes a cam mechanism 116 corresponding to one of the ejector arms 150. Although now shown, an identical cam mechanism 116 may be present on the opposite side of the printer 100 corresponding to the other one of the ejector arms 150. The previously described compression lever 22 may by modified to also create the mechanical linkage between the cover latch 110 and the ejector arms 150, so that movement of the cover latch 110 not only decouples or couples the fluid connections 140, but also electrically disconnects or allows for electrical connection of the cartridge 120 with the printer 100. In this regard, the compression lever 22 may be modified to include the cam mechanism 116.

FIG. 5 shows the pagewidth printer 100 with the cover latch 110 in the closed position, so that the cartridge 120 is properly seated in the cartridge holder 130 with fluid connections 140 coupled and electrical connections established between the cartridge 120 and the other components of the printer 100. As shown in FIG. 6, opening movement of the cover latch 110 results in rotation of the cam mechanism 116 in the direction of arrow 118 and into contact with a back wall 157 of the ejector arm 150, thereby forcing the ejector arm 150 to slide back in the direction of arrow 152. As the ejector arm 150 moves in the direction of arrow 152, the finger 154 on the ejector arm 150 pulls back on the top portion of the cartridge 120, causing the cartridge 120 to begin tilting back in the direction of arrow 122. The tilting movement of the cartridge 120 results in breakage of the electrical connections and decoupling of the fluid connections 140 with the ink supply. As shown in FIG. 7, when the cover latch 110 is completely opened, the cam mechanism 116 has forced the ejector arm 150 back into its completely retracted position, at which point the cartridge 120 is completely tilted back into engagement with a wall 132 of the cartridge holder 130. The cartridge 120 can then be easily removed for repair or replacement.

Closing movement of the cover latch 110 results in rotation of the cam mechanism 116 in the direction of arrow 117 away from contact with the back wall 157 of the ejector arm 150 and into contact with a front wall 158 of the ejector arm 150, thereby forcing the ejector arm 150 in the direction of arrow 156. Once the cover latch 110 is fully closed, the ejector arms 150 is disposed in its original position, allowing for the cartridge 120 to be titled back in the direction of arrow 124 into contact with the electrical connections and for coupling of the fluid connections 140. Alternatively, clearance may be maintained between cam mechanism 116 and front wall 158 even when the cover latch 110 is in the closed position, so that the ejector arm 150 is moved back to its original configuration by contact between the finger 154 and printhead cartridge 120 as the printhead cartridge 120 is titled back.

While particular embodiments of the invention have been illustrated and described, it would be obvious to those skilled in the art that various other changes and modifications may be made without departing from the spirit and scope of the invention. It is therefore intended to cover in the appended claims all such changes and modifications that are within the scope of this invention.

What is claimed is:

1. A printer comprising:

a printer body;

an ink supply;

a cartridge; and a cover which pivots between a first position in which at least a portion of the cartridge is exposed and a second position in which the cartridge is covered, wherein a first connection that includes an electrical connection between the cartridge and the printer body is based on a pivot of the cover from the first position to the second position, wherein the cover is coupled to an ejector that exerts a contact force in a direction parallel to an ink ejection surface on a first portion of the cartridge pivot the cartridge around a fulcrum contacting a second portion of the cartridge and to move the cartridge away from the electrical connection with the printer body when the cover is pivoted from the second position to the first position, and the cartridge is thereby electrically disconnected from the printer body, and wherein the contact force pivots the cartridge in a same rotational direction as the cover being pivoted from the second position to the first position.

2. The printer of claim 1, wherein a second connection between the ink supply and the cartridge is based on the pivot of the cover.

3. The printer of claim 2, wherein the second connection includes a connection enabling movement of fluid between the ink supply and the cartridge.

4. The printer of claim 1, wherein the ejector comprises:

an arm including a first wall;

and a connection portion connecting the cover and the arm, wherein the first connection is established by contact of the connection portion and the first wall when the cover is in the second position.

5. The printer of claim 4, wherein the arm includes a second wall, and the first connection is released by contact of the connection portion and the second wall when the cover is in the first position.

6. The printer of claim 5, wherein the connection portion includes a cam mechanism.

7. The printer of claim 5, comprising a cartridge holder including a wall which supports the cartridge.

8. The printer of claim 5, wherein the arm has a convex, and a posture of the cartridge is changed by contact of the convex and the cartridge based on the pivot of the cover.

9. The printer of claim 8, wherein the connection portion includes a cam mechanism, and the cartridge is inclined by being pivoted in a direction along a rotating direction of the cam mechanism.

10. The printer of claim 5, wherein the arm is movable along a conveyance direction of the printer body.

11. The printer of claim 10, wherein the arm includes a plurality of arms, the plurality of arms are provided in each of both sides of the printer body in plan view and in a direction perpendicular to the conveyance direction.

12. The printer of claim 10, wherein the arm moves to the conveyance direction by contact of the connection portion and the first wall of the arm when the cover is pivoted from the first position to the second position.

13. The printer of claim 12, wherein the arm moves to an opposite direction from the conveyance direction by contact of the connection portion and the second wall of the arm when the cover is pivoted from the second position to the first position.

14. A method for using a printer, comprising:

establishing a first connection that includes an electrical connection between a cartridge and a printer body by a first pivot of a cover from a first position in which at least a portion of the cartridge is exposed to a second position in which the cartridge is covered, and exerting a contact force in a direction parallel to an ink ejection surface on a first portion of the cartridge to pivot the cartridge around a fulcrum contacting a second portion of the cartridge and to move the cartridge away from the electrical connection with the printer body via an ejector coupled to the cover by a second pivot of the cover from the second position to the first position so that the cartridge is electrically disconnected from the printer body, wherein the contact force pivots the cartridge in a same rotational direction as the cover being pivoted from the second position to the first position.

15. The method for using a printer of claim 14, further comprising establishing a second connection between an ink supply and the cartridge by pivoting the cover.

16. The method for using a printer of claim 15, wherein the establishing the second connection includes establishing a connection enabling movement of fluid between the ink supply and the cartridge.

17. The method for using a printer of claim 14, wherein the establishing the first connection includes contacting of a first wall of an arm and a connection portion connecting the cover and the arm, when the cover is in the second position.

18. The method for using a printer of claim 17, further comprising releasing the first connection by contact of the connection portion and a second wall of the arm when the cover is in the first position.

19. The method for using a printer of claim 18, wherein the releasing the first connection includes contacting of a cam mechanism of the connection portion and the second wall of the arm when the cover is in the first position.

20. The method for using a printer of claim 18, further comprising changing a posture of the cartridge by contact of a convex of the arm and the cartridge according to a movement of the cover.

* * * * *